US007074171B2

(12) United States Patent
Mahlum et al.

(10) Patent No.: US 7,074,171 B2
(45) Date of Patent: Jul. 11, 2006

(54) METHOD FOR TWO-PIECE BOX CONSTRUCTION

(75) Inventors: James A. Mahlum, Shreveport, LA (US); Thomas A. Gilmore, Attica, IN (US)

(73) Assignee: J & L Group International, LLC., Keithville, LA (US)

( * ) Notice: Subject to any disclaimer, the term of this patent is extended or adjusted under 35 U.S.C. 154(b) by 0 days.

(21) Appl. No.: 10/897,999

(22) Filed: Jul. 23, 2004

(65) Prior Publication Data

US 2005/0075231 A1 Apr. 7, 2005

Related U.S. Application Data

(63) Continuation of application No. 09/663,913, filed on Sep. 18, 2000, now abandoned.

(60) Provisional application No. 60/155,755, filed on Sep. 23, 1999.

(51) Int. Cl.
*B31B 1/62* (2006.01)

(52) U.S. Cl. ..... 493/128; 493/131; 493/130; 493/141

(58) Field of Classification Search ..... 493/128, 493/114, 131, 84, 130, 141
See application file for complete search history.

(56) References Cited

U.S. PATENT DOCUMENTS 1,265,273 A 5/1918 Stokes et al.
1,293,782 A 2/1919 Hren et al.
2,574,181 A 11/1951 Hess
3,540,970 A 11/1970 Huntwork
3,709,110 A 1/1973 Lubersky
4,023,471 A * 5/1977 Royal ..... 493/114
4,201,118 A 5/1980 Calvert et al.
4,262,582 A 4/1981 Sugimoto et al.
4,717,371 A 1/1988 Everman et al.
4,798,571 A 1/1989 Everman et al.
5,024,709 A 6/1991 Faulkner et al.
5,151,075 A 9/1992 Beaulieu et al.
5,569,150 A 10/1996 Pane
5,656,007 A 8/1997 Olson et al.
5,772,569 A 6/1998 Janhonen
5,782,732 A 7/1998 Herrin
5,807,223 A 9/1998 Holton
5,853,360 A 12/1998 Jeffrey et al.
5,876,502 A 3/1999 Sugimura et al.
5,908,440 A 6/1999 McCloskey et al.
5,924,968 A 7/1999 Odenthal

OTHER PUBLICATIONS

Declaration of Robert Meyer Regarding On Sale and-or Experimental Use Activity.

* cited by examiner

*Primary Examiner*—Sameh H. Tawfik
(74) *Attorney, Agent, or Firm*—Dorsey & Whitney LLP

(57) ABSTRACT

The present invention relates to a method and apparatus for a two-piece box construction which is a continuous, in-line process in which a pair of panels or blanks are fed simultaneously from one end of the apparatus and move along a substantially linear path through the apparatus where they are joined together so that upon exit from such apparatus the joined blanks can be fed directly, in line, into a conventional folder/gluer apparatus for final folding, gluing and other processing.

13 Claims, 7 Drawing Sheets

METHOD FOR TWO-PIECE BOX CONSTRUCTION

CROSS-REFERENCE TO RELATED APPLICATION

This application is a continuation of U.S. patent application Ser. No. 09/663,913, filed on Sep. 18, 2000 now is abandoned, which claims priority to U.S. Provisional Application No. 60/155,755, filed on Sep. 23, 1999, the contents of which is incorporated in their entirety by reference herein.

BACKGROUND OF THE INVENTION

1. Field of the Art

The present invention relates generally to a method and apparatus for a two-piece box construction and more specifically to an in-line method and apparatus for a two-piece box construction in which a pair of panels or blanks move along a generally linear and parallel path to provide a continuous, in-line apparatus and process for joining two box panels or blanks together and folding the same into a box of desired configuration.

2. Description of the Prior Art

Various methods and apparatus exist for folding and gluing a corrugated or paperboard panel into a box of desired configuration. U.S. Pat. No. 5,151,075 discloses such an apparatus which is designed to receive a blank from a single stack of blanks for folding into a box of desired configuration. Folding and gluing apparatus of this type can be designed to receive blank widths of various sizes of six to eight feet or more. Prior to stacking the blanks for folding and gluing, the blanks are die cut and provided with scores and the like on an apparatus such as a rotary die and/or are provided with graphics via appropriate printing or other graphics application equipment. Unfortunately, many existing rotary dies and other panel printing or graphic application equipment is designed for blanks of a width less than what can be accommodated by existing folder/gluer apparatus and less than the width needed to provide certain desired sizes and configurations of boxes.

In such a situation, the box maker or processor is faced with the prospect of having to purchase a rotary die or other scoring equipment or a printer or other graphics application equipment which is capable of accommodating blank widths of the size needed to form the box of desired size and configuration. The need to purchase or acquire this additional equipment results in a significant capital investment which essentially either precludes the purchase of such equipment (thus not accepting the job) or significantly increases the costs associated with the box construction. Attempts have been made to solve this problem by gluing two panels together before introduction into a box folder/gluer apparatus; however, such prior attempts have not been completely successful.

Accordingly, there is a need in the art for a method and apparatus for a two-piece box construction, and specifically, a method and apparatus which is a continuous, in-line method and apparatus in which two stacks of blanks to be joined together move through the apparatus along substantially parallel and linear pathways and, upon being joined, move directly into a conventional folder/gluer for final folding, gluing and other processing.

SUMMARY OF THE INVENTION

In contrast to the prior art, the present invention relates to a method and apparatus for a two-piece box construction and more specifically to a method and apparatus for a two-piece box construction which is a continuous, in-line process in which a pair of panels or blanks are fed simultaneously from one end of the apparatus and move along a substantially linear path through the apparatus where they are joined together so that upon exit from such apparatus, the joined blanks can be fed directly, in line, into a conventional folder/gluer apparatus for final folding, gluing and other processing.

More specifically, the apparatus of the present invention includes three primary modules for feeding blanks from a pair of stacked blanks along a linear pathway and joining the same so that they can be fed, in line, into a folder/gluer. A first or feed module includes two stacks of such blanks which are positioned in side-by-side relationship at one end of the apparatus with their inner edges being parallel, but laterally spaced from one another. The feed module also provides means for applying glue to the surface of one of the blanks along a strip adjacent to its inner edge.

A second or positioning module functions to move the blanks, after they have left the feed module, laterally inwardly toward one another so that their edges to be joined overlap one another. This module includes means for stopping the linear movement of the blanks while they are moved inwardly toward one another, means for limiting the inward movement of each of the blanks and for maintaining vertical separation between the inner edge portions of the blanks and means for aligning the lead edges of such blanks in a desired linear position relative to one another.

The third or press module presses the overlapped edges of the respective blanks together with a predetermined force so that the pair of blanks are secured to one another along their overlapped portions. The third or press module is designed for connection directly to a conventional folder/gluer for final folding, gluing and other processing of the joined blanks.

The process in accordance with the present invention includes positioning a pair of stacks of corrugated cardboard or paperboard blanks adjacent to one another so that their inner edges are parallel to one another and laterally spaced from one another. A blank from each of the pair of stacks is then released simultaneously so that they move from the stacks along a substantially linear path with their inner edges being maintained substantially parallel to one another. As the blanks leave the first module, glue is applied to the surface of one of the blanks adjacent to its inner edge.

Next, the linear movement of the pair of blanks is stopped with their leading edges aligned and the blanks are moved inwardly toward one another so that their joined edges overlap to form respective overlap portions of the blanks. Such overlap portions are spaced vertically from one another.

After resuming movement of the blanks, the overlap portions are pressed together by a pair of belts to iron or to join the blanks together. The joined blanks are then fed directly into a conventional folder/gluer for folding, gluing and other processing.

Accordingly, it is an object of the present invention to provide a method and apparatus for a two-piece box construction. Another object of the present invention is to provide an in-line method and apparatus for a two-piece box construction in which a pair of adjacent blanks are fed along a parallel, linear path to be joined together and then subsequently fed into a conventional folder/gluer.

A further object of the present invention is to provide a continuous method and apparatus for forming a two-piece box construction.

A still further object of the present invention is to provide a fully automated, in-line process for a two-piece box construction.

These and other objects of the present invention will become apparent with reference to the drawings, the description of the preferred embodiment and method and the appended claims.

DESCRIPTION OF THE PREFERRED EMBODIMENT AND METHOD

The apparatus and method in accordance with the present invention is designed to join two pieces of panels or blanks together and to fold and glue the same into a box in a continuous, in-line process. Although the present invention has special applicability to blanks of corrugated board stock, the benefits of the invention are also applicable to blanks of folded carton stock and various other similar corrugated or paperboard stock.

Figure 1:
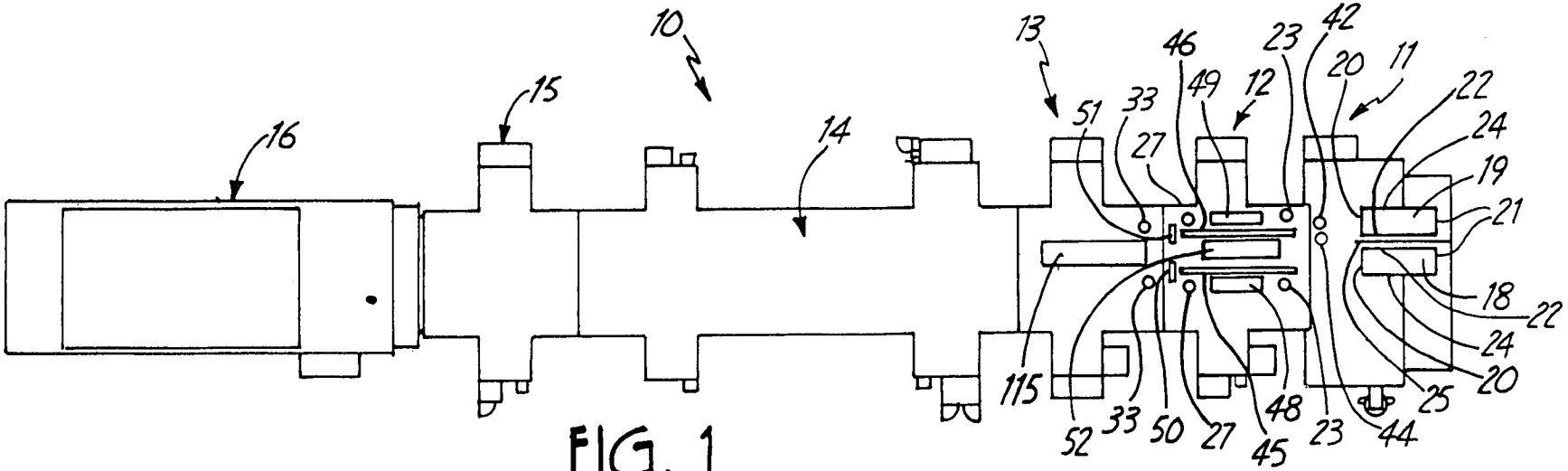
FIG. 1 is a plan view of a folder/gluer incorporating the two piece box apparatus and method in accordance with the present invention.
Figure 2:
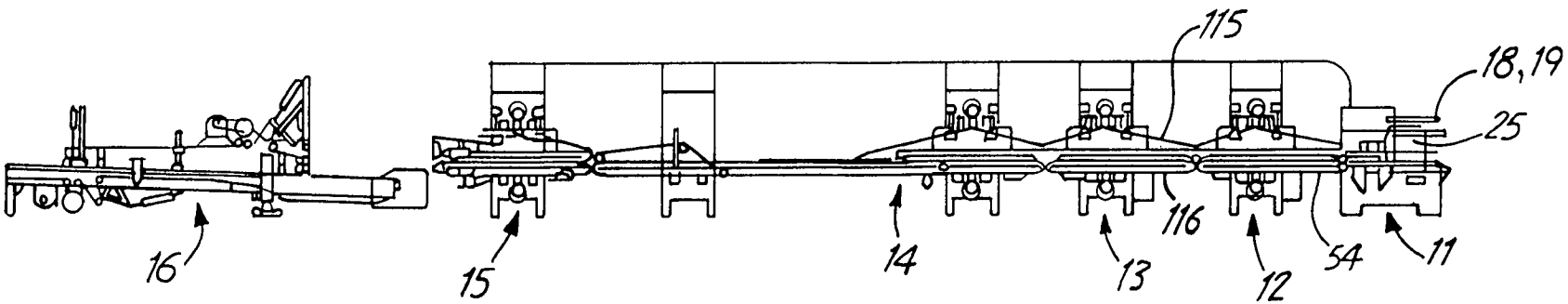
FIG. 2 is an elevational side view of the folder/gluer and two piece box apparatus shown in FIG. 1.

With reference first to FIGS. 1 and 2, the folder/gluer 10 of the present invention is comprised of a plurality of modules 11, 12, 13, 14, 15 and 16. In general, these modules 11–16 join a pair of board blanks together and then form the resulting panel into a single board box in a continuous, automated, in-line process. More specifically, the first or feed module 11 includes a pair or first and second stacks, each having a plurality of vertically stacked blanks 18 and 19, respectively. Each of these blanks 18 and 19 has a leading edge 20, a trailing edge 21, an inner edge 22 and an outer edge 24. Although the blanks 18 and 19 are shown as being generally rectangular, their configuration will vary with the particular box configuration. The blanks 18 and 19 represent blanks which have already been die cut. For purposes of describing the preferred embodiment and method, the blanks 18 and 19 travel through the system from right to left as viewed in FIGS. 1 and 2.

In accordance with the method of the present invention, individual blanks 18 and 19 from each of the stacks are sequentially fed from the bottom of the stacks. Accordingly, one or more personnel are available for replenishing cardboard blanks to the stacks as the supply is depleted. In the feed module 11, the stacks of blanks 18 and 19 are separated by an upstanding center divider 25. The divider 25 functions primarily to maintain the individual blanks 18 and 19 within the stacks in a position in which their inner edges 22 are laterally spaced from one another and are generally parallel.

Figure 3:
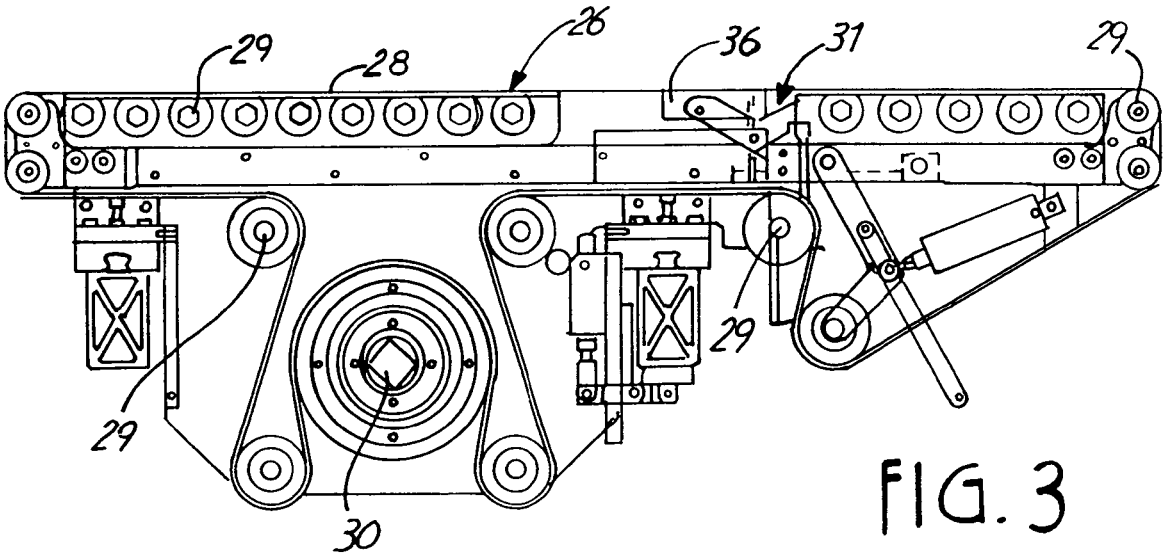
FIG. 3 is a side view of the drive belt and associated structure in the feed module of the present invention.
Figure 4:
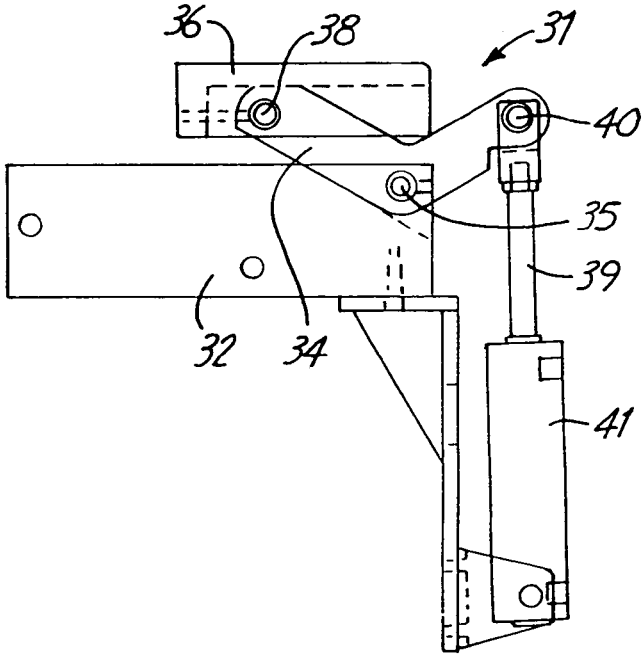
FIG. 4 is a side elevational view of the bump feed assembly associated with the feed belt of FIG. 3.

With reference to FIG. 3, the feed module 11 includes a feed belt assembly 26 comprised of an endless belt 28, a plurality of pulleys and/or rollers 29 for guiding the belt 28 in an endless path and a drive member 30 for driving the belt 28. Associated with the belt assembly 26 is a bump feed assembly illustrated generally in FIG. 3 and more specifically in FIG. 4 by the reference character 31. As shown in FIG. 4, the bump feed assembly 31 includes a bracket 32 connected with a portion of the feed module frame and a link 34 which is pivotally connected with the bracket 32 at the pivot 35. One leg of the link 34 is pivotally connected to a bump block 36 at the pivot 38, while the other leg of the link 34 is pivotally connected to the end of a piston rod 39 at the pivot 40. The piston rod 39 is connected with an air cylinder 41 rigidly secured to a portion of the bump feed assembly. By appropriate extension and retraction of the piston rod 39, the link 34 is caused to pivot about the pivot 35 and thus lower and raise the bump block 36.

In the preferred embodiment, three laterally spaced feed belt assemblies as shown in FIG. 3, together with three laterally spaced bump feed assemblies, are provided for each stack of blanks 18 and 19. When the piston rod 39 of each bump feed assembly is extended, as shown in FIGS. 3 and 4, each of the corresponding bump feed blocks 36 is in a lowered position. This allows the bottom cardboard blanks 18 and 19 to engage the belts 28 to move such blanks from the feed module. When the piston rods 39 are retracted, the corresponding bump feed blocks 36 are pivoted to a raised position. This causes the stack of blanks to be raised above the belts 28, and thus prevents the bottom blank from being fed from the feed module. Accordingly, by selectively retracting and extending the piston rods 39 of the bump feed assembly 31, the individual blanks 18 and 19 from the stacks can be selectively fed from the feed module 11 (FIGS. 1 and 2). It should be noted that as the bump blocks 36 are lowered and the bottom cardboard blank comes in contact with the moving belts 28, the weight of the other cardboard blanks in the stacks provide sufficient frictional force between the bottom blank and the belts to feed such blank from the feed module. Preferably, the feed belt assembly may also be provided with a vacuum means, conventional in the art, to assist in causing the blanks to be moved with the belt 28 and fed out of the feed module.

In the preferred embodiment, the feed belts 28 associated with each of the pair of stacks 18 and 19 are coordinated so that they move continuously and at the same speed. The movement of the bump feed blocks 36 for each of the stacks 18 and 19 are also coordinated so that they move in unison to release an individual cardboard blank 18 and 19 simultaneously from their respective stacks to be fed from the feed module simultaneously.

As the pair of cardboard blanks 18 and 19 leave the feed module 11 (FIGS. 1 and 2), the top surface of an inner peripheral edge portion of one of the blanks is provided with an adhesive for ultimately securing the blanks together. A wide variety of adhesives and adhesive applicators can be used for this purpose. Such adhesives and adhesive applicators are known to those skilled in the art. In the preferred embodiment and method, both a cold glue or adhesive as well as a hot melt glue or adhesive are utilized. In the preferred process, the cold glue has high adhesive strength, but a longer "set" time compared to hot melt glue, while the hot melt glue has a shorter set time, and thus provides for a quick tack, but has less adhesive strength than the cold glue. By using the two together, the hot melt glue sets up quickly to provide quick adhesive strength during the folding and further gluing of the box, while the cold glue provides for higher strength after it has had an opportunity to set.

It is contemplated that the adhesive can be applied to either of the pair of blanks; however, in the preferred process, the adhesive is applied to the top surface of a peripheral edge portion adjacent to the inner edge 22 of a blank from the stack 19. As shown best in FIG. 1, the adhesive is applied through a cold glue applicator 42 and a hot glue applicator 44 at the downstream end of the feed module 11. Appropriate control mechanisms are associated with the adhesive applicators 42 and 44 so that they apply adhesive only when there is a blank in position to receive such adhesive.

As the pair of blanks 18 and 19 leave the feed module, they enter the second or positioning module which aligns the leading edges of the blanks in a linear direction and slides the blanks toward one another to a desired overlap. As shown best in FIG. 1, the positioning module 12 generally includes left and right side drive wheel assemblies 45 and 46 for moving the blanks 18 and 19 linearly through the system. The module 12 also includes left and right stop gates 50 and 51 for stopping the travel of the blanks and aligning the same in a linear or longitudinal direction and left and right side pusher assemblies 48 and 49 for moving the blanks 18 and 19 toward one another to an overlapped position. The positioning module 12 also includes a center divider and separator assembly 52 for providing an adjustable overlap of the two blanks 18 and 19.

Figure 5:
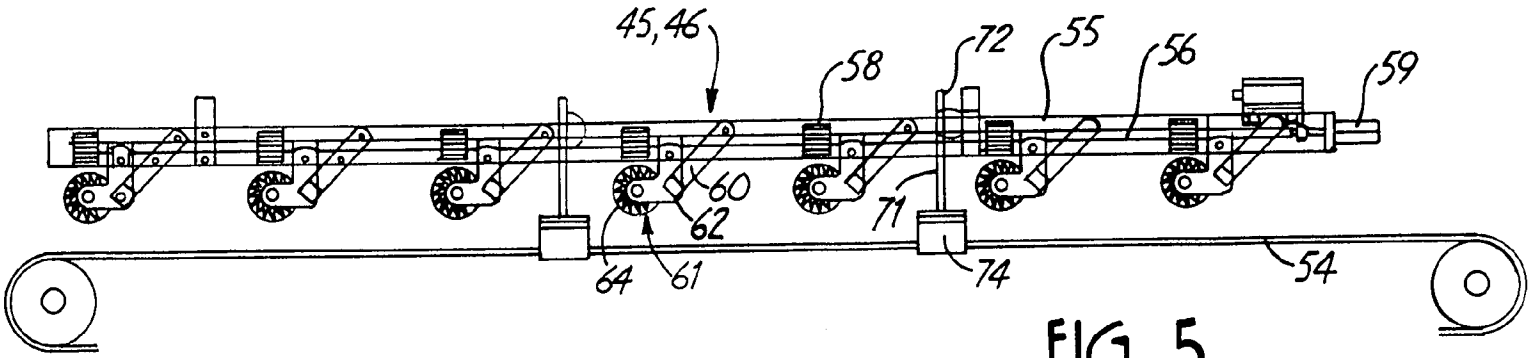
FIG. 5 is an elevational side view of the drive roller assembly for driving corrugated or paperboard blanks through the apparatus of the present invention.
Figure 6:
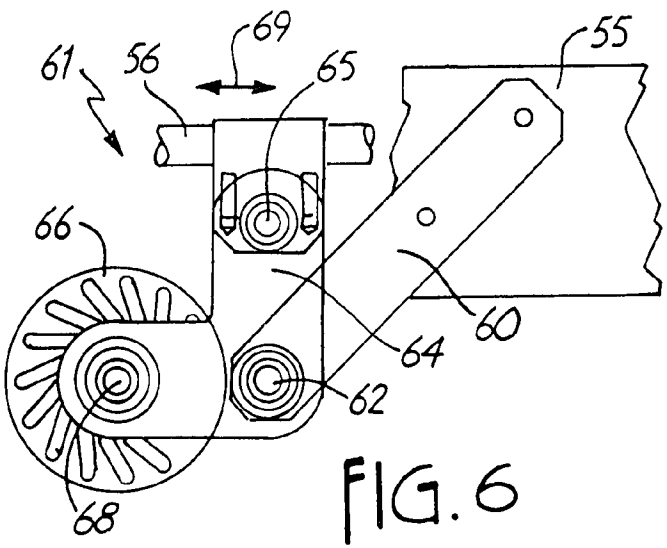
FIG. 6 is an enlarged view of a single drive roller sub-assembly.

More specifically, as best shown in FIGS. 2 and 5, the positioning module 12 includes a pair of laterally spaced endless belts 54. One of these belts 54 is designed for engagement with the bottom surface of the left side blank 18, while the other belt 54 is associated with the right side of blank 19. The belts 54 in combination with the left and right side drive wheel assemblies 45 and 46 function to move the blanks from the feed module 11, through the module 12 and toward the stop gates 50 and 51. The detailed structure of the drive assemblies 45 and 46 is shown in FIGS. 5 and 6. Each of such assemblies includes a frame 55 rigidly secured to the frame of the module 12 and an elongated rod 56 moveable linearly relative to the frame 55. The rod 56 is supported at spaced intervals along the frame 55 by a plurality of linear bearings 58 and is moved reciprocally relative to the frame 55 by an air cylinder 59. A plurality of roller mounting brackets 60 are rigidly secured to the frame 55 by appropriate means and extend downwardly and rearwardly from the frame 55 for pivotally supporting a roller assembly 61 at a pivot point 62.

As shown best in FIG. 6, each of the roller assemblies includes an L-shaped bracket 64 with a center portion pivotally connected with the bracket 60 at the pivot 62. One leg of the bracket 64 is connected with the rod 56 via a pivot connection 65. A second or lower leg of the bracket 64 pivotally supports a crushless roller 66 at the pivot 68. The roller 66 is a conventional crushless roller known to those skilled in the art and is designed to engage the top surface of the blanks to assist, in combination with the belts 54, in moving the blanks 18 and 19 through the module 12.

The connection between the upper leg of the bracket 64 and the rod 56 is a floating connection. Such connection facilitates rotation of the bracket 64 about the pivot 62 as the rod 56 moves reciprocally in a linear direction as shown by the directional arrow 69. Such reciprocal movement of the rod 56 results in corresponding upward and downward movement of the roller 66 as shown by the directional arrow 70.

With reference to FIG. 5, each drive roller assembly 45 and 46 in the preferred embodiment includes a plurality of linearly-spaced roller assemblies 61 which are all connected with the rod 56. Thus, the movement of all of the roller assemblies 61 relative to the frame 55 and thus also relative to its associated endless belt 54 is controlled by the linear movement of the rod 56 which is in turn controlled by actuation of the air cylinder 59. Specifically, as the cylinder rod of the air cylinder 59 is retracted, the rod 56 is moved toward the right as viewed in FIG. 5, thereby pivoting the brackets 64 clockwise and causing the rollers 66 to be raised. In this position, the rollers exert no downward force toward the belts 54 and thus do not assist in moving the blanks 18 and 19 through the module 12. When the cylinder rod from the air cylinder 59 is extended, the rod 56 moves toward the left as viewed in FIG. 5, thereby causing counterclockwise movement of the brackets 64 and corresponding downward movement of the rollers 66 toward the belts 54. When in this position, a downward force is exerted by the rollers 66 toward the belts 54. This downward pressure is applied through the blanks which frictionally engage the belts 54 for movement through the module 12. Although FIG. 5 shows seven linearly spaced roller assemblies, any number (either more or less than seven) could be utilized.

Also associated with each of the drive assemblies 45, 46 are a plurality of brush assemblies 71. Each of the brush assemblies 71 includes a mounting post 72 and a brush or bristle portion 74. The post 72 is adjustably mounted to the frame 55. The brush portion 74 is designed to engage the top surface of the blanks to exert a light, constant pressure against the blanks and toward the belts 54. These brush assemblies 71 are desirable to ensure continued movement of the blanks through the module 12 when the roller assemblies 61 are moved to their raised or non-engaging positions. The vertical position of the brush assembly 71 is adjustable relative to the frame 55. This adjustment adjusts the pressure which the brush portions 74 exert on the top surface of the blanks.

Figure 7:
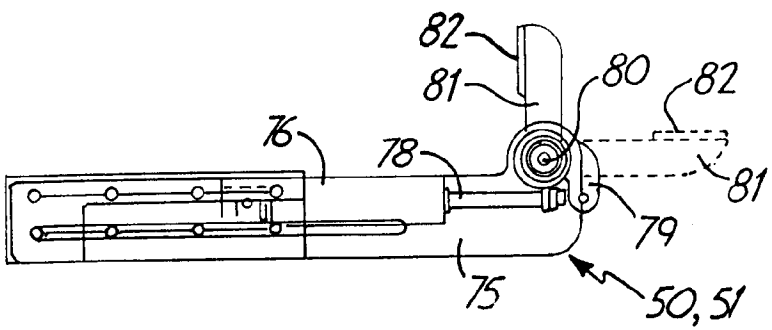
FIG. 7 is an elevational side view of a stop gate utilized in the apparatus of the present invention.
Figure 9:
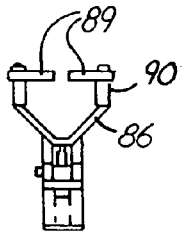
FIG. 9 is a view, partially in section, of a portion of the pusher assembly as viewed along the section line 9—9 of FIG. 8.
Figure 10:
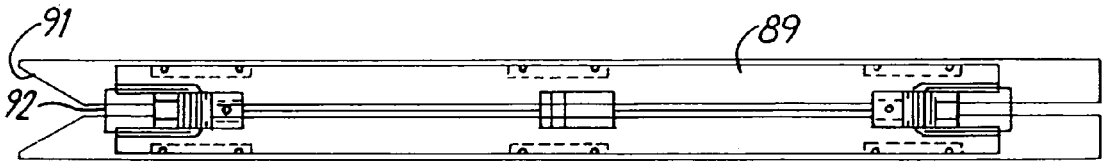
FIG. 10 is an elevational front view of the pusher block and associated structure in accordance with the present invention.

The details of each of the stop gates 50,51 are illustrated in FIG. 7. Specifically, each of the stop gate assemblies 50,51 includes a frame 75 rigidly secured to the frame of the module 12 and an air cylinder 76 with a cylinder rod 78 connected with one end of a bracket 79. The outer end of the stop gates includes a stop member 81, with the bracket 79, and thus the stop member 81, being pivotally connected to a portion of the frame 75 at the pivot 80. Although each stop gate assembly can be provided with its own air cylinder 76, a preferred embodiment provides a single air cylinder for all the stop assemblies to provide a more uniform movement. An upper or outer portion of the stop member 81 includes a stop surface 82 for engagement with the leading edge of the cardboard blanks 18 and 19 to stop the forward linear travel of the blanks. The stop member 81 is moveable between an upper stop position as shown by the solid lines in FIG. 7 in which the cylinder rod 78 is extended and a lowered or non-stop position shown by the broken lines in FIG. 7 in which the cylinder rod 78 is retracted. The cylinder 76 is in turn provided with a source of air pressure (not shown) and control means for selectively extending and retracting the cylinder rod 78. The detailed structure of the left and right side pusher assemblies 48 and 49 is illustrated best in FIGS. 8, 9, 10 and 11. Specifically, with reference first to FIG. 8, each of the pusher assemblies 48,49 includes a base 84 rigidly secured to the frame of the module 12. Mounted to the base 84 are a pair of slide rails 85 which are parallel to one another and extend laterally, at right angles to the linear movement of the blanks through the module 12. Slidably mounted on the rails 85 is a pusher block assembly comprised of a pusher bar 86 in the form of an angle member extending linearly in a direction generally parallel to the travel of the cardboard blanks through the module 12. The pusher bar 86 is slidably mounted to the rails 85 via a pair of appropriate slide members 88 and functions to support a pair of spaced guide members 89,89. As shown, the guide members 89,89 are rigidly secured to outer ends of the angled pusher bar 86 by a plurality of connection members 90. As illustrated best in FIGS. 9 and 10, the inner edges of the guide members 89,89 are spaced from one another a distance greater than the thickness of the blanks. The ends of the guide members 89,89 facing the feed module 11 are provided with beveled lead-in surfaces 91,91 to guide the cardboard blanks 18 and 19 moving through the module 12 into the space or gap between the members 89,89.

Figure 11:
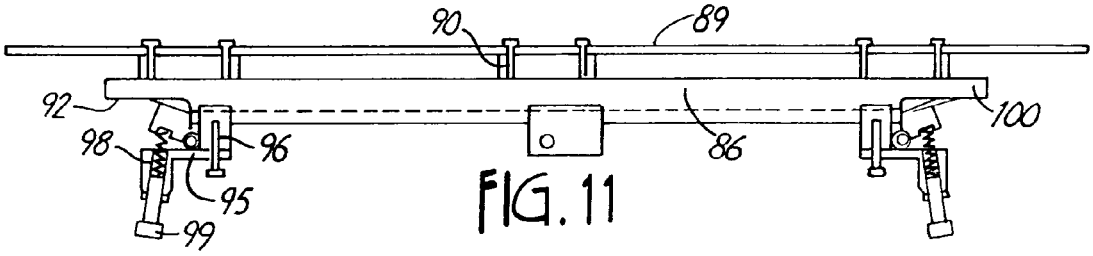
FIG. 11 is an elevational top view of the pusher block and associated structure in accordance with the present invention.

A pair of fingers 92 are pivotally mounted relative to the pusher bar 86 near each end at the pivot 94. Specifically, each finger 92 is pivotally connected to an adjustment bracket 95 which is in turn rigidly secured to the pusher bar 86 by the connecting bolt 96. Each of the fingers 92 is spring loaded via the spring 98. The loading force of the spring 98 against the finger 92 is adjustable via the adjustment screw 99. The outermost position of the finger 92, as shown best in FIG. 11, is defined by spaced outer end portions 100 of the pusher bar 86.

Figure 8:
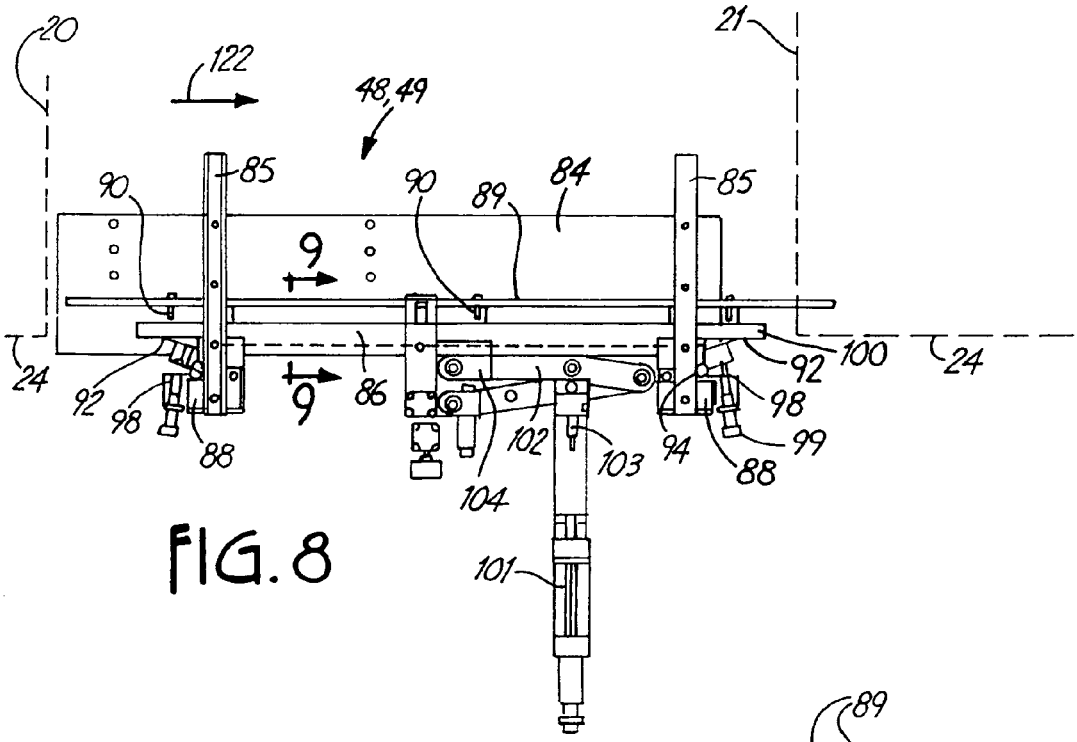
FIG. 8 is an elevational plan view of the pusher assembly in accordance with the present invention.

As shown in FIG. 8, a pusher cylinder 101 and a pusher linkage 102 are operatively connected to the pusher bar 86 through the connection block 104 for the purpose of moving the pusher bar 86 and its associated structure reciprocally along the rails 85. Specifically, as the cylinder rod of the pusher cylinder 101 extends and retracts, the linkage 102 causes movement of the pusher bar 86 toward and away from the longitudinal center of the module 12. Thus, each of the pusher bars 86 and associated structure is moveable between a retracted or outer position as illustrated in FIG. 8 and an inner or extended position in which the pusher bar 86 is moved inwardly toward the center of the module 12. As will be discussed below, the extent of this movement defines the extent of the overlap between the cardboard blanks 18 and 19 as they are moved toward one another. The pusher cylinder includes adjustment means by which the extent of the movement of the pusher cylinder, and thus the pusher bar 86, can be adjusted.

Also associated with the pusher assembly is a reed switch 103 which senses when the pusher bar 86 has reached its extended or outermost position. This in turn signals that the blanks have been laterally moved to their overlap position and that the next pair of blanks can be released and fed from the feed module 11 into the module 12.

The pusher assemblies 48,49 are mounted to the frame of the module 12 at opposite sides of the module 12 in a position where the pusher bar 86, and specifically the spring loaded fingers 92,92 will be in a position to engage the outer side edge of the respective blanks 18 and 19. Specifically, FIG. 8 shows the position of the pusher assemblies 48,49 relative to its respective blanks 18 and 19. In the preferred embodiment, the pusher assemblies 48,49 are positioned such that as the leading edge 20 of a respective blank moves toward the pusher assemblies 48,49, an outer portion will be guided by the lead-in edges 91 into the gap between the guide members 89. Following continued movement of the blanks 18,19 to their respective stop positions, movement of the pusher bar 86 toward its extended position will cause engagement between the spring loaded fingers 92 and the outer edge of the respective blank 18,19 to cause movement of the blank 18,19 toward the center of the module 12.

Figure 12:
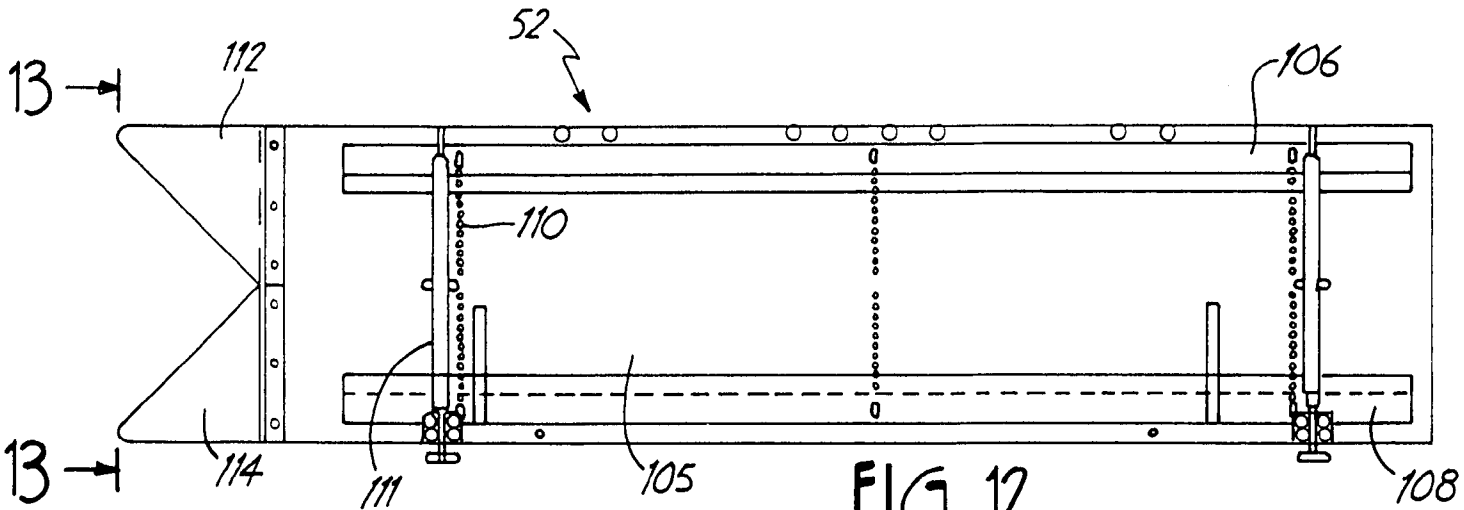
FIG. 12 is an elevational plan view of the separator assembly for forming the overlap between adjacent blanks.
Figure 13:
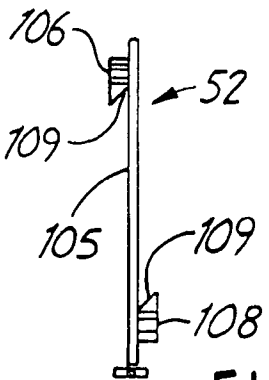
FIG. 13 is a view, partially in section, of the separator as viewed along the section line 12—12 of FIG. 12.

The details of the center divider or separator are shown best in FIGS. 12 and 13. Specifically, the center divider assembly 52 includes a base 105 and a pair of elongated stop rails 106 and 108 mounted to opposite surfaces of the base 105 as shown best in FIG. 13. The stop rails 106 and 108 are laterally spaced from one another in a direction transverse to the linear movement of the panels through the module 12 and are generally parallel to one another. As shown best in FIG. 12, each of the rails 106 and 108 includes a generally V-shaped stop surface 109. The stop surfaces 109 are designed to receive the inner edges 22 of the blanks 18 and 19 and to define the innermost movement of such blanks.

The assembly 52 also includes a plurality of adjustment openings 110 in the base 105 and a threaded adjustment rod 111 for selectively adjusting the respective positions of the stop rails 106 and 108 relative to one another. By adjusting the position of the rails 106 and 108 toward one another, the amount of overlap of the blanks 18 and 19 will be reduced, while adjustment of the rails 106 and 108 away from one another results in the overlap of the blanks 18 and 19 being increased. Preferably, the range of adjustment is between about 2 inches and 10 inches. More preferably, the range of adjustment is on or between about 1⅜ inches to 5 inches. The end of the base 105 facing the feed module 11 is provided with a pair of guide flaps 112 and 114 for guiding the blanks 18,19 either downwardly or upwardly so that the blanks are moved laterally inwardly by the pusher assemblies 48,49, they will be guided into the V-shaped stop surfaces 109 of the rails 106 and 108. As shown in FIGS. 11 and 12, the flap 112 is folded down, thereby guiding its respective blank into the surface 109 of the rail 108, while the flap 114 is folded up, thereby guiding its respective blank into the surface 109 of the rail 106. The orientation of the flaps 112 and 114 and the rails 106 and 108 is such that the blank containing the glue is positioned below the blank without the glue. This facilitates the respective blanks being adhesively secured to one another.

Figure 14:
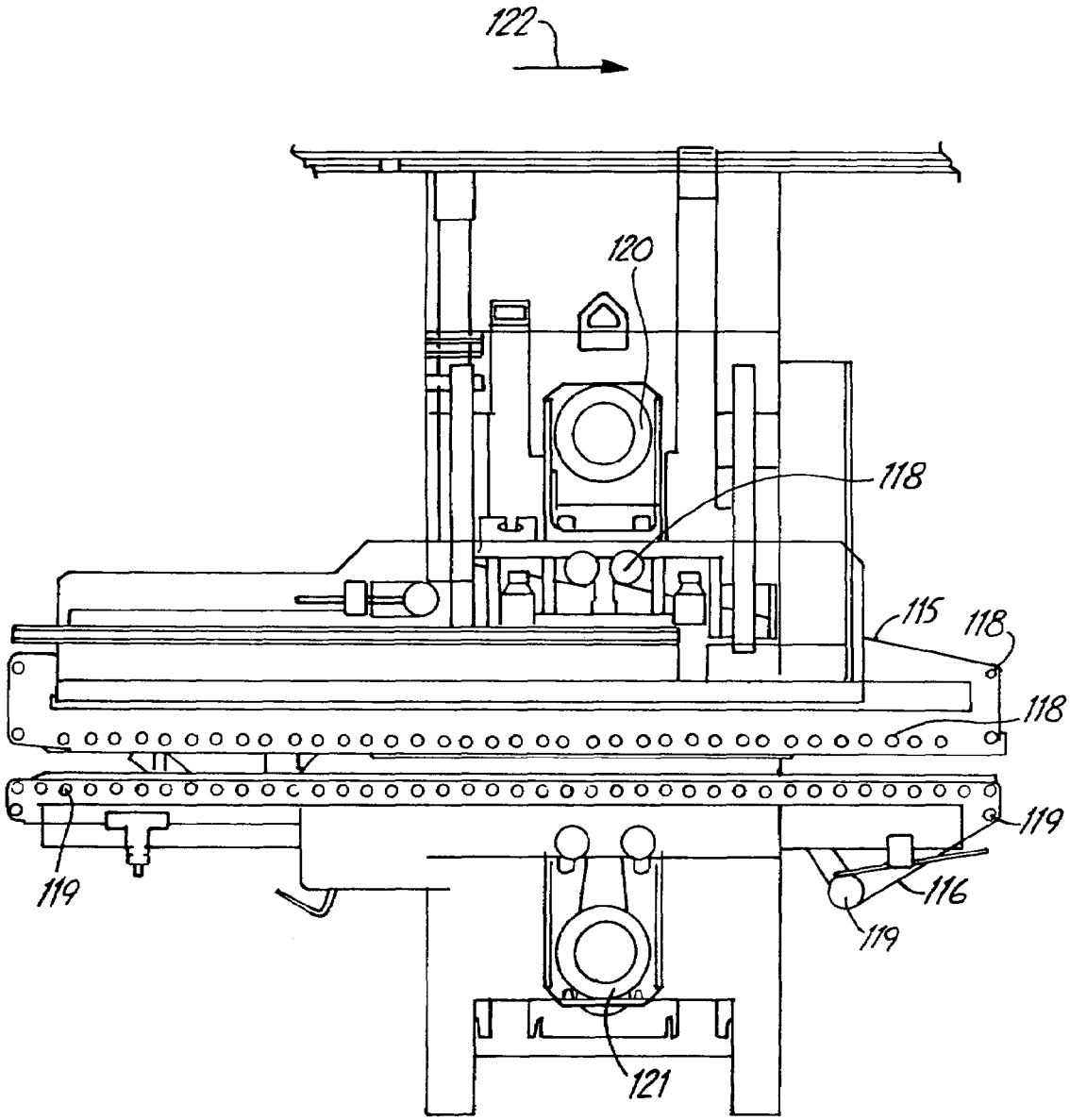
FIG. 14 is a side elevational view of the belt assembly for pressing the overlapped glued portions of blanks together.

The third or press module 13 (FIGS. 1 and 2) functions primarily to press or iron the overlapped edges of the blanks together so that they are adhesively secured to one another. In the preferred embodiment, the means for accomplishing this function comprises a pair of endless belts 115 and 116 (FIG. 14) which are aligned with the glued overlap seam of the blanks 18 and 19. The pair of endless belts include upper 115 and lower 116 endless belts which are generally centrally positioned and thus aligned with the overlapped portions of the blanks. The pair of belts 115 and 116 also function to pull the joined blanks 18 and 19 from the module 12 through the module 13 in the direction of the arrow 122 (FIG. 14) and then subsequently into the module 14 for subsequent folding, glueing and other processing of the type which is common in the prior art. As shown, the belts 115 and 116 are supported by a plurality of rollers/pulleys 118 and 119, respectively. Appropriate drive means 120 and 121, respectively, are associated with the belts 115 and 116 for driving the same. Means are also provided for selectively raising and lowering the belts 115 and 116 relative to one another. The belts 115 and 116 are conventional belts commonly found in folder/gluer equipment for advancing blanks through the system.

In addition to the various structural elements described above, control means and a variety of switches, timers, photo eyes and the like are provided for controlling the travel of the blanks 18,19 through the modules, for identifying the position of the blanks within the modules, and and for activating and deactivating each of the various functional elements described above and coordinating their respective activation and deactivation.

Having described the structure of the preferred embodiment of the present invention in detail, the operation and the timing sequence of each of the operational elements can be described as follows:

During a cycle of the apparatus described above, a pair of blanks 18 and 19 are fed simultaneously along a linear path from their respective stacks. At a point during the cycle the blanks are stopped, with their leading edges aligned, and are moved laterally toward one another to an overlap position. The glued overlapped portions are then pressed together to form the pair of blanks 18 and 19 into a single panel or blank which can then be introduced into a conventional folder/gluer for conventional folding, gluing or other processing.

Figure 15:
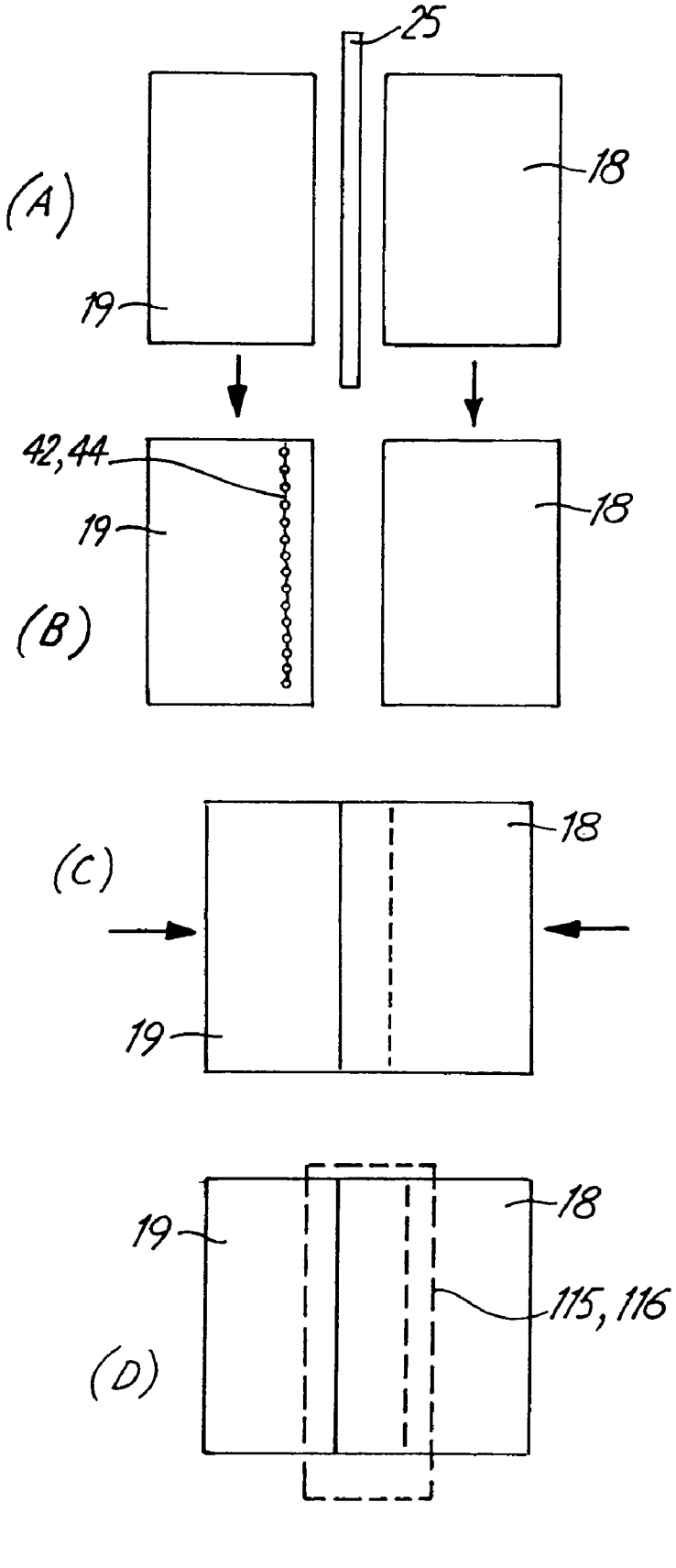
FIG. 15 is a schematic flow diagram showing the process in accordance with the present invention.

Accordingly, the general process steps of the present invention can be shown best with reference to FIG. 15 and illustrations A, B, C, and D of FIG. 15. As shown in illustration "A", individual blanks 18 and 19 in a pair of stacks are fed from the stacks simultaneously and linearly. As they are fed, glue is applied to the top surface of the blank 19 along a strip closely adjacent to its inner edge. Preferably the glue is a combination of hot and cold glue 42,44 as shown in illustration "B". As shown in illustration "C", the blanks 18 and 19 are then moved toward one another to an overlapped position in which the inner edge of the blank 18 overlaps and is above an inner edge portion of the blank 19. Following this, as shown in Illustration "D", the overlapped portion of the blanks 18 and 19 are pressed or ironed together by a pair of endless belts 115,116. At this time, the blanks 18 and 19 have been joined into a single larger blank which can be fed into a folder/gluer or other blank processing equipment conventional in the art.

To begin a cycle, the air cylinder 41 (FIG. 4) is activated so that it moves to its extended position. This lowers the bump feed block 36 so that the bottom blanks 18,19 of their respective stacks engage the continuously moving endless belts 28. The belts 28 move the laterally spaced blanks 18,19 linearly and simultaneously in the same direction out of the feed module 11 and into the positioning module 12. As the blanks 18,19 leave the module 11 an upper surface of an edge portion of one of the blanks 18,19 is provided with a desired combination of cold and hot melt glue. When the leading edges 20 of the blanks 18 and 19 reach the bump feed or first set of photo eyes 23,23, an electrical signal is provided which activates the bump feed cylinder 41 toward its retracted position and thus raises the bump feed block 36, thereby preventing release of a further blank. During this time, the rollers 66 of the drive roller assemblies 45 and 46 are in their down or driving position to assist in moving the blanks 18,19 from the feed module 11 and through the positioning module 12. When the leading edges 20 of the blanks 18,19 reach the second or drive wheel set of photo eyes 27,27, a timing sequence is commenced that controls several separate time delayed sequential functions, namely, raising and lowering of the drive rollers 66, extension and retraction of the pusher assemblies 48 and 49 and lowering of the stop gates 50 and 51. In the preferred embodiment, the timer value for each function is designed to be adjustable through an operator interface terminal to accommodate different sizes of blanks and other operational variables. The first function in the timing sequence is the retraction of the drive wheel cylinder 59 to raise the drive rollers 66. The timing is such that these rollers will rise when the leading edges of the blanks 18,19 are about half way between the drive wheel photo eyes 27,27 and the stop gates 50 and 51. The specific time delay before the solenoid fires to raise the drive rollers 66 is controlled by an internal timer in the PLC. At desired operational speeds, this occurs approximately 20 milliseconds after the timing sequence is commenced. After the rollers 66 have been raised, the brush assemblies 71 (FIG. 5) provide sufficient pressure on the blanks 18 and 19 against the belt 54 to maintain sufficient forward movement of the blank. During this period, the stop gates 50 and 51 are in their up position as shown in FIG. 7. This stops the forward linear movement of the blanks 18 and 19 when they reach that position.

After the drive rollers have been raised and as the blanks 18 and 19 are about to reach the stop gates 50 and 51, the pusher cylinders 101 of the pusher assemblies 48 and 49 are activated to move the blanks 18 and 19 laterally toward against the center divider backstop rails 106 and 108 (FIGS. 12 and 13). The timed delay before the pusher assemblies 48 and 49 fire to their extended position is controlled by an internal timer in the PLC which, at desired operational speeds, approximates 30 milliseconds after the timing sequence is commenced. After the pusher assemblies are fully extended and the lead edges 20 of the blanks are aligned against the stop gates 50 and 51, the stop gates 50 and 51 are lowered and the drive rollers 66 are lowered to move the blanks from the module 12. The specific time, at which the stop gates 50,51 are lowered, at desired operational speeds, approximates 60 milliseconds after commencement of the timing sequence. Also when the pusher assemblies are fully extended, the reed switch 103 (FIG. 8) sends a signal to activate the bump feed to release a further set of blanks.

After a specified period of time, the pusher cylinders 101 are activated to move the pusher assemblies 48 and 49 to their retracted positions. The specific amount of time before this occurs is sufficient to allow the stop gates 50 and 51 to be moved to their lowered position and for the blanks 18 and 19 to be moved past the pusher assemblies 48 and 49. Thus, the pusher assemblies 48 and 49 remain in their extended positions while the blanks move linearly from the module 12. The amount of time delay before the pushers retract is controlled by an internal timer in the PLC. When the blanks have left the module 12, the trailing edges 21 of the blank are detected by a third set of photo eyes 33, 33 in the module 13. This set of photo eyes 33,33 could be replaced by a single photo eye 33 if desired. This photo eye 33 signals that the blanks 18 and 19 have left the module 12 and moved past the stop gates 50,51. The stop gates 50,51 are then returned to their up position in response to this signal. During operation, all belts in the various modules move at the same speed.

As the two aligned and overlapped blanks move from the module 12 and into the press module 13, the overlapped portions with the adhesive therebetween is pressed or ironed between the set of upper and lower carriage belts 115 and 116. In addition to pressing the overlapped portions of the blanks 18 and 19 together, the carriage belts transport the joined blanks 18 and 19 through the module 13 and into the module 14. The module 14 is intended to be a module available in the prior art such as a conventional folder/gluer.

Although the description of the preferred embodiment has been quite specific, it is contemplated that various modifications could be made without deviating from the spirit of the present invention. Accordingly, it is intended that the scope of the present invention be dictated by the appended claims rather than by the description of the embodiment.

The invention claimed is:

1. A method for making a multiple piece box from first and second blanks comprising:

providing a supply of said first and second blanks in first and second feed members, each of said first blanks having a first connection edge and an outer edge opposite to said first connection edge and each of said second blanks having a second connection edge and an outer edge opposite to said second connection edge;

feeding said first and second blanks simultaneously from said first and second feed members and conveying said first and second blanks in a travel direction at the same speed and for the same distance along parallel paths wherein said travel path is parallel to said first and second connection edges and wherein said first and second connection edges of said first and second blanks are parallel and adjacent to one another throughout their conveyance along said paths during said feeding step;

applying an adhesive to at least one of said first connection edges;

moving at least one of said first and second blanks toward the other of said first and second blanks after said feeding step so that one of said first and second connection edges overlaps the other of said first and second connection edges with the adhesive therebetween; and pressing said first and second connection edges together after said applying step and after said moving step.

2. The method of claim 1 wherein said pressing step forms a multiple piece blank and the process further comprises forming said multiple piece blank into a multiple piece box.

3. The method of claim 2 including aligning the blanks prior to the pressing step until the first blank is in a desired position relative to the second blank.

4. The method of claim 1 being continuous.

5. The method of claim 1 wherein said moving step includes moving each of first and second blanks toward the other.

6. A method for making a multiple piece box from first and second blanks comprising:

providing a supply of said first blanks and a supply of said second blanks, each of said first blanks having a first lead edge, a first connection edge and an outer edge opposite to said first connection edge and each of said second blanks having a second lead edge, a second connection edge and an outer edge opposite to said second connection edge;

feeding said first and second blanks from said supply of first blanks and said supply of second blanks along parallel paths which are parallel to said first and second connection edges with said first and second connection edges being parallel to and laterally spaced from one another and said first and second lead edges being linearly aligned with one another during said feeding step;

applying an adhesive to at least one of said first and second connection edges and thereafter positioning said first and second blanks so that one of said first and second connection edges overlaps the other with said adhesive therebetween;

pressing said first and second connection edges together to form a multiple piece blank; and maintaining the first and second lead edges in linear alignment during said feeding, applying and pressing steps.

7. The method of claim 6 including forming said multiple piece blank into a multiple piece box.

8. The method of claim 6 including aligning the blanks until the first blank and the second blank are in a desired position relative to one another before said pressing step.

9. The method of claim 6 wherein said positioning step includes moving both said first and second blanks toward one another to an overlap position.

10. A method for making a multiple piece box from first and second blanks comprising:

providing a supply of said first blanks and a supply of said second blanks, each of said first blanks having a first lead edge, a first connection edge and an outer edge opposite to said first connection edge and each of said second blanks having a second lead edge, a second connection edge and an outer edge opposite to said second connection edge;

sequentially feeding corresponding said first and second blanks from said supply of first blanks and said supply of second blanks along linear paths at the same speed and for the same distance, wherein said first and second connection edges of said corresponding first and second blanks are laterally spaced from one another and said first and second lead edges of said corresponding first and second blanks are aligned with one another and wherein said linear paths are parallel to said first and second connection edges during said feeding step;

applying an adhesive to at least one of said first and second connection edges and thereafter positioning said first and second blanks so that one of said first and second connection edges overlaps the other with said adhesive therebetween; and pressing said first and second connection edges together to form a multiple piece blank.

11. The method of claim 10 including forming said multiple piece blank into a multiple piece box.

12. The method of claim 10 including aligning the blanks until the first blank and the second blank are in a desired position relative to one another before said pressing step.

13. The method of claim 10 wherein said positioning step includes moving both first and second blanks toward one another in an overlap position.

* * * * *